US009702064B2

(12) United States Patent
Goenka et al.

(10) Patent No.: US 9,702,064 B2
(45) Date of Patent: Jul. 11, 2017

(54) WOVEN FABRIC WITH BULKY CONTINUOUS FILAMENTS YARNS AND RELATED MANUFACTURING METHODS

(71) Applicant: WELSPUN INDIA LIMITED, Mumbai (IN)

(72) Inventors: Dipali Goenka, Mumbai (IN); Subrata Palit, Mumbai (IN)

(73) Assignee: Welspun India Limited, Mumbai (IN)

( * ) Notice: Subject to any disclaimer, the term of this patent is extended or adjusted under 35 U.S.C. 154(b) by 0 days.

(21) Appl. No.: 15/275,278

(22) Filed: Sep. 23, 2016

(65) Prior Publication Data

US 2017/0088979 A1 Mar. 30, 2017

Related U.S. Application Data

(60) Provisional application No. 62/232,769, filed on Sep. 25, 2015.

(51) Int. Cl.

| | |
|---|---|
| ***D03D 15/00*** | (2006.01) |
| ***D02G 3/36*** | (2006.01) |
| ***D02G 3/04*** | (2006.01) |
| *D03D 13/00* | (2006.01) |

(52) U.S. Cl.
CPC ..... *D02G 3/36* (2013.01); *D02G 3/04* (2013.01)

(58) Field of Classification Search
CPC ..... A01N 25/34; D03D 15/00; D03D 15/0077
See application file for complete search history.

(56) References Cited

U.S. PATENT DOCUMENTS

| | | | |
|---|---|---|---|
| 4,191,221 | A | 3/1980 | Boyer |
| 4,578,306 | A | 3/1986 | Heiman |
| 4,654,254 | A | 3/1987 | Gerry et al. |
| 4,679,326 | A | 7/1987 | Takizawa et al. |
| 4,742,183 | A | 5/1988 | Soloway et al. |
| 5,495,874 | A | 3/1996 | Heiman |
| 7,673,656 | B2 | 3/2010 | Heiman |
| 7,726,348 | B2 | 6/2010 | Heiman |
| 8,186,390 | B2 | 5/2012 | Krishnaswamy et al. |
| 8,671,476 | B2 | 3/2014 | Stewart et al. |
| 8,833,075 | B2 | 9/2014 | Pursifull et al. |
| 9,481,950 | B2 | 11/2016 | Agarwal |

(Continued)

FOREIGN PATENT DOCUMENTS

EP 2703557 A1 3/2014

OTHER PUBLICATIONS

European Patent Application No. 16190632.6—1710: Extended European Search Report dated Jan. 30, 2017, 9 pages.

*Primary Examiner* — Bobby Muromoto, Jr.
(74) *Attorney, Agent, or Firm* — Baker & Hostetler LLP

(57) ABSTRACT

An embodiment of the present disclosure is a woven fabric comprising a plurality of warp yarns. Each one the warp yarns is a staple spun yarn. The fabric includes a plurality of weft yarns interwoven with the plurality of warp yarns to define the woven fabric. Each one of the plurality of weft yarns is a high bulk textured continuous filament yarn. The woven fabric defies a first side and a second side that is opposed to the first side. The plurality of weft yarns are interwoven with the plurality of warp yarns such that the weft yarns define a substantial majority of the face of the woven fabric, thereby exposing high bulk textured continuous filament yarns along a substantial majority of the face.

30 Claims, 6 Drawing Sheets

(56) References Cited

U.S. PATENT DOCUMENTS

| | | | | |
|---|---|---|---|---|
| 2003/0190853 | A1 | 10/2003 | Lovingood | |
| 2004/0229538 | A1* | 11/2004 | Love, III | D03D 17/00 442/182 |
| 2005/0282452 | A1* | 12/2005 | Love, III | D03D 17/00 442/182 |
| 2007/0014967 | A1 | 1/2007 | Tingle et al. | |
| 2008/0057813 | A1 | 3/2008 | Tingle et al. | |
| 2009/0308404 | A1* | 12/2009 | Leonard | A01N 25/10 128/889 |
| 2009/0312684 | A1* | 12/2009 | Leonard | A01N 25/10 602/44 |
| 2010/0050316 | A1* | 3/2010 | Leonard | A01N 25/10 2/114 |
| 2011/0016631 | A1* | 1/2011 | Stewart | A47G 9/0284 5/501 |
| 2011/0111164 | A1 | 5/2011 | Mandawewala | |
| 2013/0008554 | A1 | 1/2013 | Fisher et al. | |
| 2015/0047736 | A1 | 2/2015 | Agarwal | |

* cited by examiner

WOVEN FABRIC WITH BULKY CONTINUOUS FILAMENTS YARNS AND RELATED MANUFACTURING METHODS

CROSS-REFERENCE TO RELATED APPLICATIONS

The present application claims priority to, and the benefit of, U.S. Provisional Application No. 62/232,769, filed Sep. 25, 2015, entitled "Woven Fabric With Bulky Continuous Filaments Yarns, Bedding Articles, And Related Manufacturing Methods," the entire disclosure of which is incorporated by reference into this application for all purposes.

TECHNICAL FIELD

The present disclosure relates to a woven fabric with high bulk continuous filaments yarns and related manufacturing methods.

BACKGROUND

Bedding products, such as sheeting, are typically woven fabrics made from 100% cotton fibers or cotton and synthetic fiber blends. Synthetic fiber blends that include polyester, acrylic, nylon, or viscose rayon fibers are also widely used for sheeting applications. Maximizing durability, softness and other performance features that meet consumer preferences is challenging and unpredictable. The demand for improved bedding products is strong which indicates a need for the right combination of product attributes that can meet that demand.

SUMMARY

There is a need for a woven fabric that has high bulk continuous filaments yarns disposed on one side of the fabric, bedding articles made from same, and related manufacturing methods. An embodiment of the present disclosure is a woven fabric comprising a plurality of warp yarns. Each one the warp yarns is a staple spun yarn. The fabric includes a plurality of weft yarns interwoven with the plurality of warp yarns to define the woven fabric. Each one of the plurality of weft yarns is a high bulk textured continuous filament yarn. The woven fabric defies a first side and a second side that is opposed to the first side. The plurality of weft yarns are interwoven with the plurality of warp yarns such that the weft yarns define a substantial majority of the face of the woven fabric, thereby exposing high bulk textured continuous filament yarns along a substantial majority of the face.

Another embodiment of the present disclosure is a woven fabric, comprising a plurality of warp yarns. Each one of the plurality of warp yarns is a high bulk textured continuous filament yarn. The woven fabric includes a plurality of weft yarns interwoven with the plurality of warp yarns to define the woven fabric. Each one the plurality of weft yarns is a staple spun yarn. The woven fabric defines a face and a second side that is opposed to the face. The plurality of weft yarns are interwoven with the plurality of warp yarns such that the warp yarns define a substantial majority of the face of the woven fabric, thereby exposing high bulk textured continuous filament yarns along a substantial majority of the face.

Another embodiment of the present disclosure is a woven fabric, comprising a plurality of warp yarns and a plurality of weft yarns interwoven with the plurality of warp yarns to define the woven fabric. In the woven fabric, either a) an entirety of the weft yarns are high bulk textured continuous filament yarns and the warp yarns are staple spun yarns, or b) an entirety of the warp yarns are high bulk textured continuous filament yarns and the weft yarns are staple spun yarns. The woven fabric defines a face and a second side that is opposed to the face. The plurality of weft yarns are interwoven with the plurality of warp yarns such that the high bulk textured continuous filament yarns define a substantial majority of the face of the woven fabric.

Another embodiment of the present disclosure is a method of manufacturing a woven fabric. The method includes the step of weaving the woven fabric with a plurality of warp yarns and a plurality of weft yarns. In the weaving step, either a) an entirety of the weft yarns are high bulk textured continuous filament yarns and the warp yarns are staple spun yarns, or b) an entirety of the warp yarns are high bulk textured continuous filament yarns and the weft yarns are staple spun yarns. The weaving step arranges the warp and weft yarns such that the high bulk textured continuous filament yarns define a substantial majority of a face of the woven fabric.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown.

DETAILED DESCRIPTION OF ILLUSTRATIVE EMBODIMENTS

Figure 1:
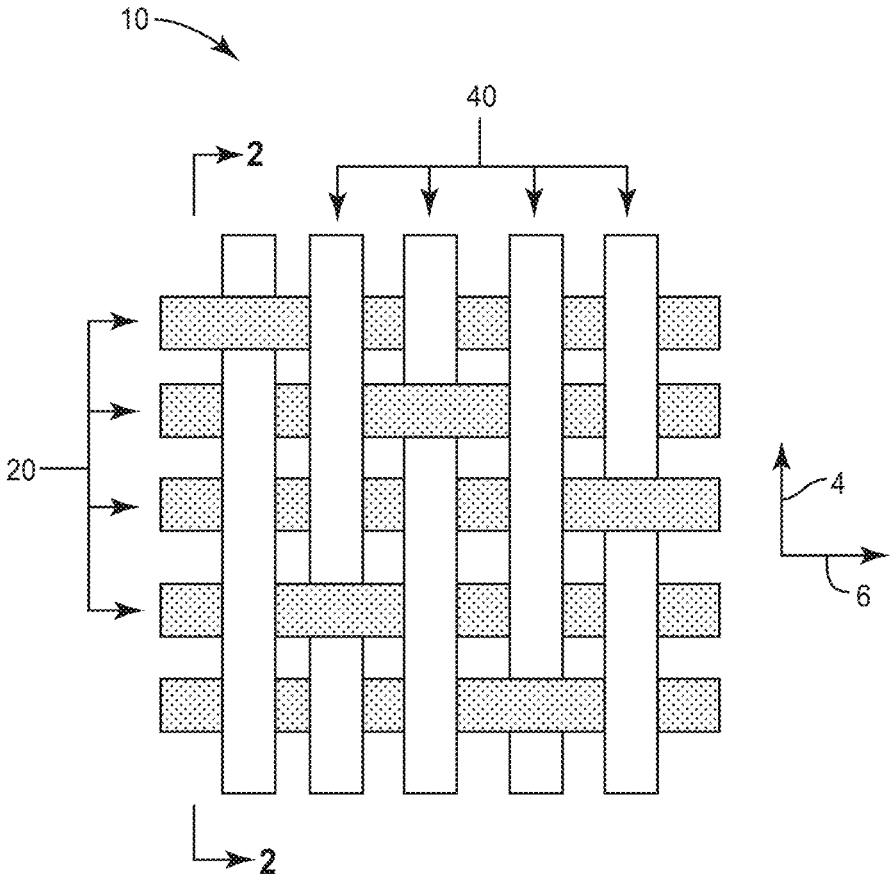
FIG. 1 is a plan view of a woven fabric according to an embodiment of the present disclosure.
Figure 2:
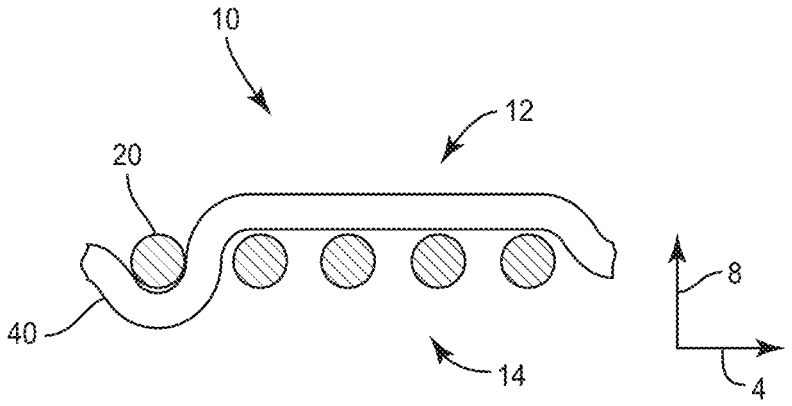
FIG. 2 is cross-sectional view of the woven fabric taken along line 2-2 in FIG. 1.

Turning to FIGS. 1 and 2, an embodiment of the present disclosure is a woven fabric 10 having a plurality of warp yarns 20 and a plurality of weft yarns 40 interwoven with the plurality of warp yarns 20 to define the woven fabric 10. In accordance with present disclosure, either a) the weft yarns 40 are high bulk textured continuous filament yarns and the warp yarns 20 are staple spun yarns, or b) the warp yarns 20 are high bulk textured continuous filament yarns and the weft yarns 40 are staple spun yarns. The woven fabric 10 includes a face 12 and a back 14 opposite the face 12 along direction 8. The warp yarns 20 extend along a warp or longitudinal direction 6 and the weft yarns 40 extend along a weft direction 4 (or lateral or cross direction). The woven fabric is designed such that a substantial portion of the face 12 includes exposed high bulk textured continuous filament yarns and a substantial portion of the back 14 includes exposed staple spun yarns. Furthermore, the high bulk textured filament yarns can be dyed prior to fabric formation, e.g. dope dyed, solution dyed, or package dyed.

The woven fabric as disclosed herein has improved performance features over typical woven products, such as those used as sheeting products. For instance, woven products as described herein have stain release functionality, are bleach safe, display good color fastness to benzoyl peroxide, salicylic acid, retinol, and other cosmetic ingredients. The woven fabrics have good color fastness properties in home laundering and light fastness, and improved antistatic properties. The use of high bulk yarns also result in a soft, bulky, fabric hand.

As described above, embodiments of the present disclosure include bedroom articles, including, but not limited to flat sheets, fitted sheets, pillow cases, shams, euro shams, comforters, duvets, bed-skirt, blankets, mattress covers, and the like. One embodiment is a coordinated bedding system comprising a plurality of system components. The system components include a comforter, a duvet, a bed skirt, a blanket, and two or more a flat sheet, a fitted sheet, a pillow case, or a sham. Each system component includes the woven fabric prepared in accordance with the present disclosure. Furthermore, the bedding articles are manufactured such that the high bulk, textured weft yarns define the face of the bedding article. In alternative embodiments, the woven fabrics can be used in garments.

The woven fabric 10 may be defined by a number of different woven structures. Exemplary woven structures include, but are not limited to: plain weaves; basket weaves, satins (e.g. satin dobby base, satin stripe satin 5/1, satin 4/1 satin; 4/1 satin base strip; 4/1 stain swiss dot; 4/1 down jacquard; 5/1 satins); rib weaves (e.g. 2×1 rib weave; 2×2 rib weave; or 3×1 rib weave); twill weaves, percale, and oxford weaves. In one example, the woven fabric is a plain weave. In another example, the woven fabric is a satin weave. In another example, the woven fabric is a 4/1 satin. In another example, the woven fabric is a 4/1 satin dobby diamond weave. In another example, the woven fabric is a 4/1 satin dobby stripe. In another example, the woven fabric is a 4/1 satin jacquard weave. In one example, the plurality of warp yarns are arranged to define a warp end density between about 50 warp ends per inch and about 300 warp ends per inch. The weft yarns are arranged to define a weft density between about 50 picks per inch and about 300 picks per inch. The woven fabric design is such that the face of the fabric is substantially comprised of high bulk, texturized weft yarns. In some cases, the weave design is used to present the weft yarn on the face of the fabric, e.g. satin weaves. In other examples, the bulk of the weft yarns create the effect that the filamentary fibers extend out from the fabric such that the face of the fabric is predominately the weft filaments. For example, the warp end density may be adjusted (decreased) to increase the number of weft yarns per square inch, which can increase the amount of bulky weft yarns extending outwardly from the fabric face.

The woven design includes several variations, including where: a) the weft yarns 40 are high bulk textured continuous filament yarns and the warp yarns 20 are staple spun yarns; b) the warp yarns 20 are high bulk textured continuous filament yarns and the weft yarns 40 are staple spun yarns; c) the weft yarns 40 are exclusively high bulk textured filament yarns the warp yarns do not include any filament yarns; and d) the warp yarns 20 are exclusively high bulk textured filament yarns and the weft yarns 40 do not include any filament yarns. Where high bulk continuous filaments are used, the woven fabric design is selected so that the high bulk continuous filament yarns comprise a substantial majority of the face 12.

In an exemplary embodiment, the warp yarns 20 include staple spun yarns and the weft yarns 40 are high bulk continuous filament yarns. The warp and weft yarns are described below consistent with such an embodiment for clarity of description. It should evident that the either warp or weft yarns can comprise the high bulk continuous filament yarns and the other of the warp and weft yarns comprise staple spun yarns.

In accordance with the illustrated embodiment, the woven fabrics includes staple yarns formed from natural fibers or a blend of natural and synthetic fibers. In one example, the staple yarns are spun, cotton fiber yarns or blended yarns. While the staple yarn is preferably cotton, in certain alternative embodiments, the staple yarn can include cotton fibers blended with other natural or synthetic fibers. In such an example, the natural fibers could include silk, linen, flax, bamboo, hemp, wool, and the like. The synthetic fibers in this example are those fibers that result in fabric structures with good hand, drape, and softness. Such synthetic fibers include cellulosic fibers, including rayon fibers (e.g. Modal, Lyocell) or thermoplastic fibers, such as polyethylene terephthalate (PET) fiber, polylactic acid (PLA) fiber, polypropylene (PP) fibers, polyamide fibers, and microfiber staple fibers.

The staple yarns can be formed using a variety of staple yarn formation systems. For instance, staple yarn formation may include bale opening, carding, optionally combing, drafting, roving, and yarn spinning (yarn spinning processes are not illustrated) to the desired count and twist level. In some cases, the staple yarns can be plied into 2-ply, 3-ply, or 4-ply configurations. After yarn spinning, the staple yarns are wound into the desired yarn packages for weaving. In one example, ring spinning is the preferred spinning system. However, the staple yarns can be formed using open end spinning systems, rotor spun spinning systems, vortex spinning systems, core spinning yarns, jet spinning yarns, or compact spinning systems. Furthermore, the spinning system may include methods used form the Hygrocotton®, disclosed in U.S. Pat. No. 8,833,075, entitled "Hygro Materials for Use In Making Yarns And Fabrics," (the 075 patent). The 075 patent is incorporated by reference into present disclosure. Accordingly, the staple yarns can be ring spun yarns, open end yarns, rotor spun yarns, vortex spun yarns, core spun yarns, jet spun yarns, or compact spun yarns. In another embodiment, the warp yarns can be Hygrocotton® yarns marketed by Welspun India Limited. Furthermore, yarns can be formed as disclosed in the 075 patent. Preferably, the staple yarn is a ring spun yarn. The staple yarn, however, be any type of spun yarn structure.

While the yarns are described in relation to the process used to make them, one of skill in the art will appreciate that the each staple yarn described above has structural differences unique to each yarn formation system. Thus, the description of the yarns above is also a description of yarn structure. Furthermore, in certain alternative embodiments, the warp yarns can be filament yarns, such as when the weft yarns are staple spun yarns and the woven fabric design is such that a substantial portion of the face 12 is exposed warp yarns The staple yarns have a range of counts for the yarn types and fibers as described above. For instance, the staple yarn can have count in a range between about 30 Ne (177 denier) to about 80 Ne (66.4 denier). In one example, the staple yarn can have a count in a range between about 30 Ne (177 denier). In one example, the staple yarn can have count in a range between about 40 Ne (133 denier). In another example, the staple yarn has a count of about 60 Ne (88.6 denier). In another example, the staple yarn has a count of about 70 Ne (75.9 denier). In another example, the staple yarn has a count of about 80 Ne (66.4 denier). In one example, the warp yarn is 2-ply yarn. In another example, the warp yarn is a 3-ply yarn.

The woven fabric also includes continuous filament, high bulk yarns. In one example, the high bulk yarns are polyethylene terephthalate (PET) filament yarns. While the continuous filament, high bulk yarn are primarily formed from PET, in alternative embodiments, the continuous filament, high bulk yarn are formed from other synthetic filaments, such as polylactic acid (PLA) fiber, polypropylene (PP) fibers, and polyamide fibers. The continuous filament, high bulk yarns can have a range of yarn counts. For instance, in one example, the continuous filament, high bulk yarn can have count in a range between about 20 denier to about 250 denier (21 Ne). The high bulk yarns can have range of number of filaments per yarn, such as between 100 to about 250 filaments per yarn. More than 250 filaments per yarn or less than 100 filaments per yarn are possible.

Embodiments of the present disclosure include the continuous filament, high bulk yarns dyed prior to fabric formation. For example, the continuous filament, high bulk yarn can be a dope-dyed, continuous filament yarn. In another example, the continuous filament, high bulk yarn can be dyed using a disperse dyes via package dyeing process (not shown). As used herein, a "dyed continuous filament yarn" means a yarn dyed prior to fabric formation whereby coloring agents are within the morphology of the filaments that form the yarns. In one example, the high bulk texturized continuous filament yarns may be a polyethylene terephthalate (PET) continuous filament yarns and the staple spun yarns are can be formed from natural fibers, e.g. cotton fibers.

A high bulk yarn as used herein refers to continuous filament yarn having a higher thickness for an equivalent yarn count. Yarn thickness is measured by observing a distance that is perpendicular to a length direction of the yarn that just contains all of the filaments of the yarn. Specifically, the distance can be distance between parallel planes that just contact the outer most filaments. Such a distance can be determined using image analysis techniques and the like. For instance, yarn thickness can be measured by fixing a yarn with little to no tension cross-wise with respect to a length scale. The thickness is the distance from two parallel lines (or planes) that just contain the outer most filaments. As used herein the high bulk yarns have a thickness that ranges from about 0.5 mm to about 5.0 mm for yarn counts between about 50 and about 250 denier. In one example, the high bulk yarns have a thickness that ranges from about 1.0 mm to about 5.0 mm for a 20 denier yarn. In one example, the high bulk yarns have a thickness that ranges from about 1.0 mm to about 5.0 mm for a 75 denier yarn. In one example, the high bulk yarns have a thickness that ranges from about 1.0 mm to about 5.0 mm for a 100 denier yarn. In one example, the high bulk yarns have a thickness that ranges from about 1.0 mm to about 5.0 mm for a 150 denier yarn. In one example, the high bulk yarns have a thickness that ranges from about 1.0 mm to about 5.0 mm for a 175 denier yarn. In one example, the high bulk yarns have a thickness that ranges from about 1.0 mm to about 5.0 mm for a 150 denier yarn. In one example, the high bulk yarns have a thickness that ranges from about 1.0 mm to about 5.0 mm for a 200 denier yarn. In one example, the high bulk yarns have a thickness that ranges from about 1.0 mm to about 5.0 mm for a 250 denier yarn.

Figure 6:
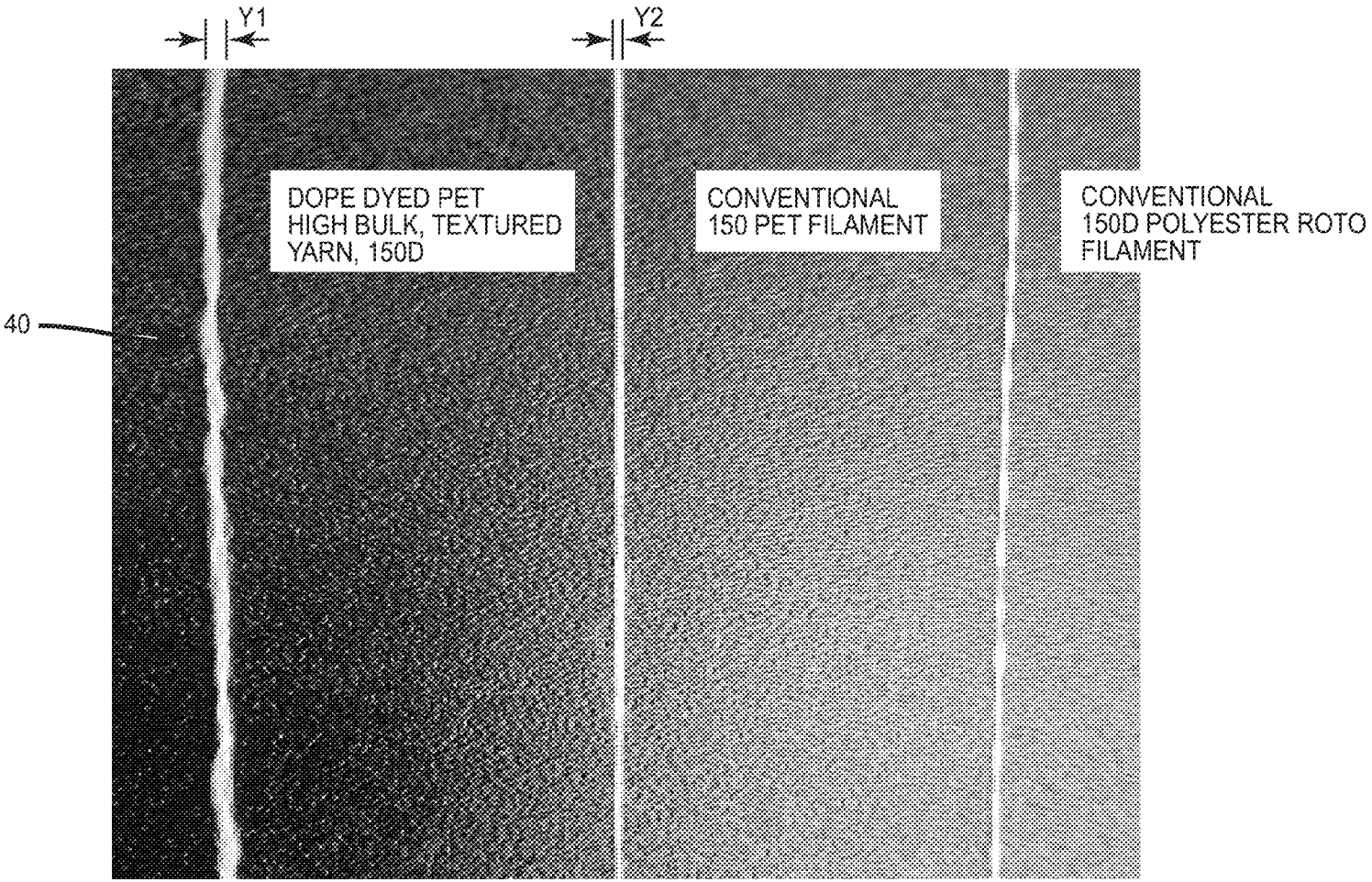
FIG. 6 illustrates high bulk textured yarn used in the fabric shown in FIGS. 1 and 2 compared to typical continuous filament yarns for similar deniers.

The inventors have also characterized the high bulk yarns in terms of a bulk ratio. The yarn thickness of yarns described herein may about 10% to about 300% greater thickness than a similar yarn having the same yarn denier. The bulk ratio is a ratio of a first yarn thickness Y1 to a second yarn thickness Y2, where the first yarn and second yarn have similar yarn counts and number of filaments per yarn. The yarn thickness Y1 and Y2 are illustrated in exemplary filaments illustrated in FIG. 6. The high bulk yarns as described herein have a bulk ratio of at least 1.20. For instance, the bulk ratio may be between 1.1 to about 3.0. For purposes of determining the bulk ratio, the yarn thickness is measured as described above. This process is repeated for two yarns, one yarn formed as described herein and the second yarn being a convention yarn having the same count. The bulk ratio is calculated.

Figure 3A:
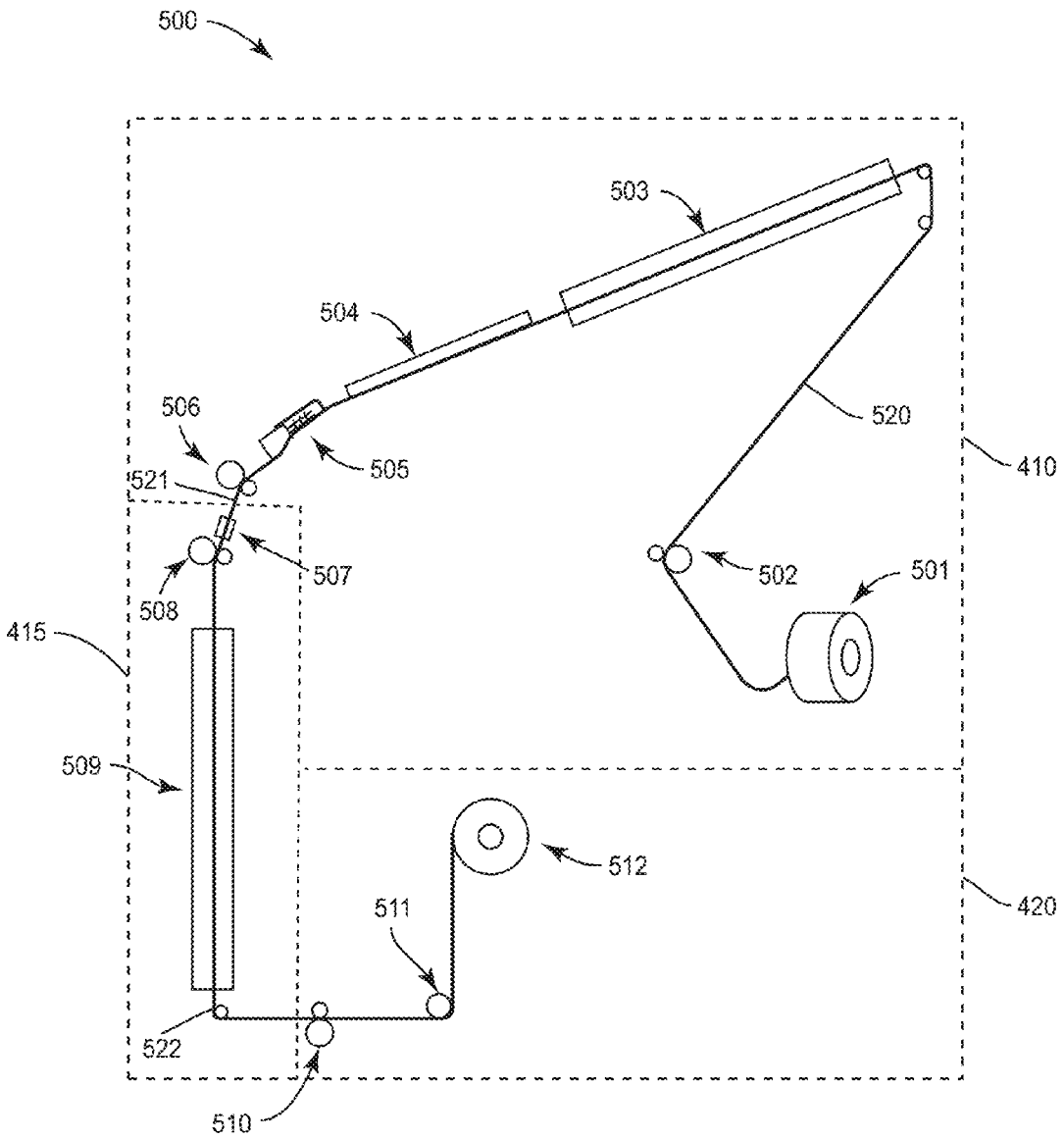
FIGS. 3A and 3B are schematics of a texturizing apparatus used to form the high bulk, textured yarn in the woven fabric shown in FIGS. 1 and 2.
Figure 3B:
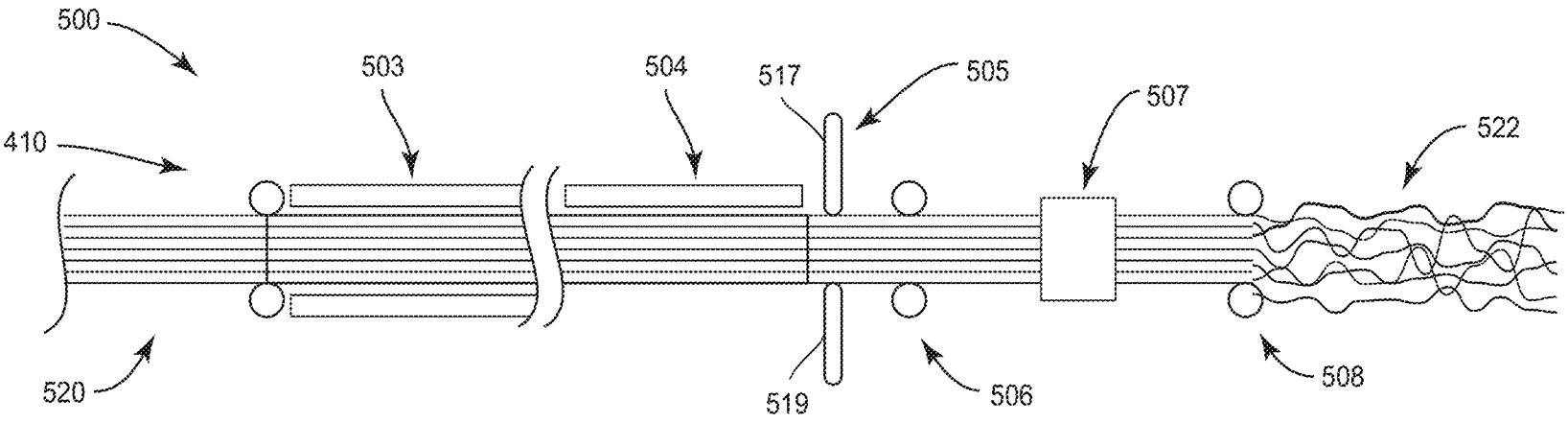
Figure 4:
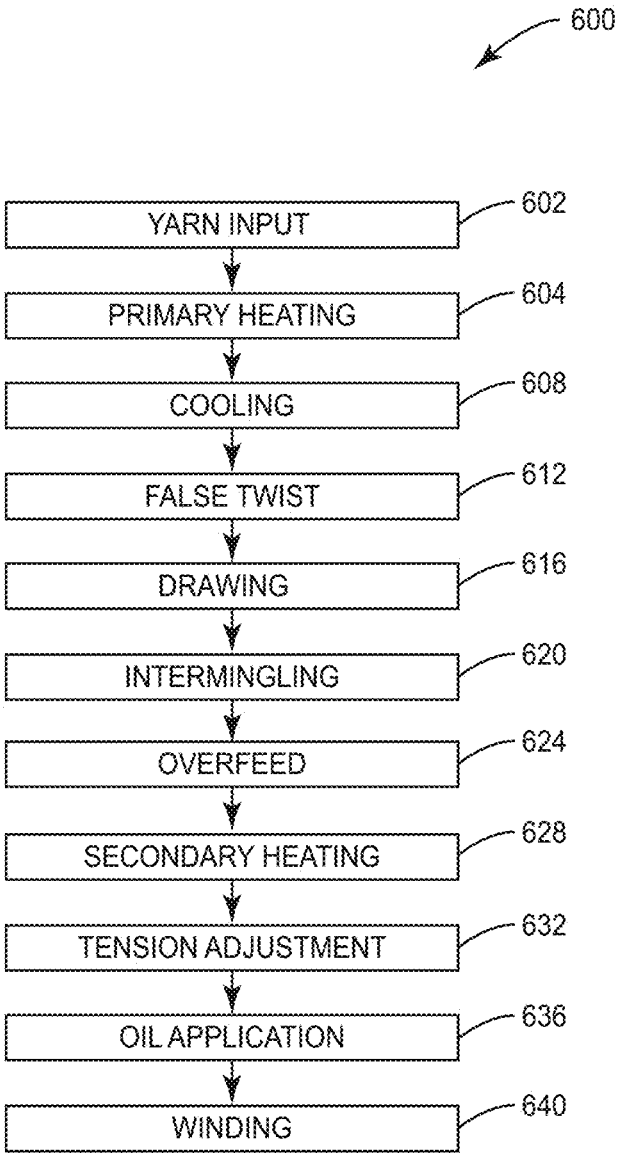
FIG. 4 is a process flow diagram for the texturizing apparatus shown in FIG. 3A.

The continuous filament, high bulk yarn can be processed via melt spinning followed by texturizing method 600 illustrated in FIG. 4 using the texturing apparatus 500 illustrated in FIGS. 3A and 3B. Typical melt spinning system, although not illustrated, is apparent to those of skill in the art, includes a polymer storage unit, a melt spinning unit, and a take-up system. Each component of the melt spinning system will be described next.

As is typical in melt spinning, polymer resin is fed from a storage unit to the melt spinning unit in the form of polymer chips. The polymer chips are dried to remove moisture. The melt spinning system can be used for form range of continuous filament yarn types, such as a fully oriented yarn, a partially oriented yarn, or a low oriented yarn. The melt-spinning unit includes one or more extruders, a spin beam, a spin pack assembly. In embodiments where the high bulk continuous filament yarn is dope dyed or solution dyed, a color master batch is dossed via a gravimetric feeder as needed to obtain the desired color. The polymer is melted and homogenized in an extruder, which advances the polymer melt line to the spin beam. The spin beam consists of a manifold that distributes the molten polymer and a melt pump. The temperature of a PET polymer melt in the spin beam, for example, is between about 280° C. to about 290° C. From the spin beam, the polymer melt flows into the spin pack assembly. The spin pack assembly consists of a filter and spinnerets. The filter removes impurities from the polymer melt and spinnerets converts polymer into filaments. The filter may include fine metallic sand particles as part of a filter medium. Filament formation occurs when the polymer melt is ejected out of the spin pack assembly through the spinnerets to form filaments, which are drawn via the take-up system.

The take-up system further processes the filaments to quench and draw as desired for the application. After quenching, a finish applicator applies a spin finish to the filaments to reduce friction, improve binding, and prevent static charge. The finish applicator spreads the spin finish uniformly over the surface of the drawn filaments. An optional intermingling nozzle may be used to impart nodes in the filaments to bind the individual filaments together and aid subsequent winding/unwinding operations. The filaments are then wound onto a yarn package with a winder. In one example, certain process parameters and melt spinning system components have been found to be beneficial in forming continuous filament high bulk yarns including: spinneret arrangement; use of fine metallic sand for filtration of spinning lower denier per filament (DPF) yarns; minimized spin finish applicator distance from the spinneret; spin finish based on an emulsion for deep penetration of spin finish into filament bundle; and migration nozzles to uniformly distribute spin finish oil over the surface of the yarn.

After melt-spinning, the filament yarn is textured as described herein to form the high-bulk continuous filament yarns using the texturing apparatus 500 as illustrated in FIGS. 3A and 3B and texturing method process 600 illustrated in FIG. 4. The texturizing apparatus 500 increases the overall yarn bulk, texture, and volume of the continuous filament yarn for a given linear density as discussed above. Specifically, the texturizing apparatus 500 imparts twist into the filament yarn. The twisted filament yarn is then heat set in a "twisted" configuration. After the twist is heat set and cooled, additional entangling steps add further bulk and softness to the yarn. The result is a unique, high bulk continuous filament yarn that has more bulk and greater volume than a similar continuous filament yarn having the same denier and number of filaments per yarn. The texturing apparatus 500 and the related process 600 will be described in detail next.

Referring to FIGS. 3A and 3B, the texturing apparatus 500 includes a first texturing unit 410, a second texturing unit 415, and a take-up unit 420. In general, a filament threadline 520 is deformed, or twisted, and set, via the first texturing unit 410. The second texturing unit 415 imparts further bulk and loft to the filament threadline 520 and sets the added bulk to form a high bulk filament threadline 522. The take-up unit 420 collects the high bulk filament threadline 522 into a suitable package for further processing. Accordingly, the texturing apparatus 500 subjects the threadline 520 to twist-entangling process to impart bulk. The apparatus 500 is schematically illustrated in FIGS. 3A and 3B for illustrative purposes. In one example, however, the thread path--the line along which threadline 520 and 522 travel through the texturing apparatus 500 from the yarn source 501 to the final wound package can be substantially linear for optimum processing. The first texturing unit 410, second texturing unit 415, and a take-up unit 420 will be described next.

Continuing with FIGS. 3A and 3B, the first texturing unit 410 includes a yarn source 501, an input feed roller 502, a first heating unit 503 (sometimes referred to as a primary or initial heater), a cooling plate 504, a false-twist unit 505, and intermediate rollers 506. The input yarn source 501 is preferably a package comprising a partially oriented filament yarn (POY). A POY can be deformed during subsequent heating phases along the apparatus 500. More specifically, the POY can withstand subsequent, multiple rearrangements of internal fiber morphology resulting from multiple heating-deformation-cooling cycles used in apparatus 500 to create the high bulk yarns as described herein. A POY yarn as used herein is referred to as a threadline 520. In one example, the POY filament yarn has about 144 filaments with a DPF of about 1.0. It should be appreciated that more or less filaments can be used depending on spinning system parameters. It should be further appreciated that in alternative embodiments, the input yarn source 501 can be an oriented yarn package, a low oriented yarn (LOY) package, or a threadline from the output of the melt-spinning system. The input rollers 502 guide the threadline 520 into first heating unit 503 and aids in drawing the threadline 520.

Continuing with FIGS. 3A and 3B, the first heating unit 503 exposes the threadline 520 to thermal energy while the false twist unit 505 imparts a desired level of twist into the threadline 520. The first heating unit 503 can be a typical thermal heating device that exposes the threadline 520 to a desired temperature, dependent in part on filament composition. The cooling plate 504 is maintained at ambient or below ambient temperatures and exposes the threadline 520 to temperatures below the temperatures in the first heating unit 503. The temperature of the cooling plate 504 is selected to set deformation imparted into threadline 520 by the twist unit 505 and by drawing of filaments due to operation of input rollers 502 and intermediate rollers 506. The false-twist unit 505 is a device configured to impart false twist into the filament bundle that comprises the threadline 520. In particular, the false twist unit 505 includes a pair of friction disks 517 and 519 that are used to twist the threadline 520. While friction disks are illustrated, other means to impart twist may be used as well, such as rotating belts and the like. The false twist unit 505 delivers threadline 520 to the intermediate rollers 506.

Continuing with FIG. 3A and 3B, the input rollers 502 and intermediate rollers 506 operate at first and second rotational speeds S1 and S2, respectively, to draw the threadline 520 to the desired draw ratio. The rotational speed S2 of intermediate rollers 506 is greater than the rotational speed Si of input rollers 502, thereby drawing the threadline 520 as it passes through the first heating unit 503, cooling plate 504, and false twist unit 505. Typically, the draw ratio of the threadline is related to the ratio of the second speed S2 to the first speed S1. Speeds S1 and S2 can be selected as needed depending on the application and desired yarn parameters. In any event, the first texturing unit 410 is configured to simultaneously draw the threadline 520, apply twist along the threadline 520, and set the threadline 520 prior to the threadline entering the second texturing unit 415. The threadline 520 entering the second texturing 520 unit 415 can be referred to as a twisted or bulked threadline 521 (see FIG. 3A).

Continuing with FIGS. 3A and 3B, the threadline 520 exits the first texturing unit 410 and enters the second texturing unit 415 as a twisted threadline 521. The second texturing unit 415 includes an intermingling jet 507, jet-overfeed rollers 508, and the second heating unit 509. In the second texturing unit 415, further bulk is imparted to the threadline 521 via intermingling jet 507. The added bulk is heat set via the second heating unit 509 to yield a high bulk threadline 522. The intermediate rollers 506 also control tension along the threadline as it enters the intermingling jet 507. The intermingling jet 507 includes one or more nozzles and a gas source (not shown), such as air. The intermingling jet 507 injects air into the threadline 520 via the nozzles to induce filament entanglements and add bulk along the threadline at the location following the intermediate rollers 506. The intermediate rollers 506 operate at rotational speed that is greater than the rotational speed of the rollers 502. Jet-overfeed rollers 508 operate at a rotational speed that lower than the intermediate rollers 506 so to overfeed filaments into jet 507. Jet-overfeed rollers 508 operate at a rotational speed that is about the same as speed of the output rollers 510. The rollers 508 overfeed filaments in the threadline into the second heating unit 509. The second heating unit 509 can be a typical thermal heating device that exposes the threadline to a desired temperature. From the second heating unit 509, the high bulk threadline 522 enters the take-up unit 420.

As can be seen FIG. 3A, the take-up unit 420 includes output delivery rollers 510, an oil applicator 511, and a winding unit 512. The output delivery rollers 510 control tension of the threadline 522 and present the threadline 522 to an oil applicator 511. The oil applicator 511 is configured to apply a lubricant to the threadline 522. The winding unit 512 can be a typical winder, such a random or precision winder, designed build the threadline 522 a suitable yarn package for further processing.

It should be appreciated that the apparatus can be configured to process multiple threadlines 520 and multiple yarn packages for use in later textile operations. As such a texturing system may include a plurality of similar texturing apparatuses 500 as described above.

Turning now to FIG. 4, a process 600 used to form a high bulk continuous filament yarn using the apparatus 500 according to an embodiment of the present disclosure is illustrated. Process 600 initiates with a yarn input step 602 where the yarn source supplies the continuous filament threadline to the first heating unit 503 and false twist unit 505 (FIG. 3A). Next, a heating step 604, exposes the threadline to an elevated temperature. For example, the heating unit may expose the continuous filament threadline to the polymer glass transition temperature or higher. After the heating step 604, a cooling step 608 cools the threadline with a cooling plate. During the heating step 604 and cooling step 608, a false twist step 612 imparts twist to the continuous filament threadline via a false twist unit. During the false twisting step 612, the continuous threadline is also subject to drawing. Specifically, the speed differential between input rollers 502 and intermediate rollers 506 draws the filament threadline while the false twist unit 505 applies twist to the threadline. The twisting step 612 and drawing step 616 occur simultaneously during the heating step 604 and cooling step 608, such that the continuous filament threadline is subject to deformation (twist and attenuation or drawing) and setting in one phase of the process 600.

Continuing with FIG. 4, an intermingling step 620 adds additional bulk to threadline. A jet, such as jet 507 shown in FIG. 3A, entangles the filaments in threadline. The intermingling step 620 is included to add softness to the yarn, which results in softness and bulk in the final woven fabric. An overfeeding step 624 overfeeds the threadline into the second heating unit to aid in entanglement and setting of the deformed, bulked filament. The overfeeding step 624 aids in jet entangling. A second heating step 628 sets the overfed, bulked threadline to yield a high bulk continuous filament yarn as described herein. Next, a tension step is used to control or adjust tension along the threadline via output rollers 510 and winding speed at winder unit 512. See 510 and 512 in FIG. 3A. An oil application step 536 imparts a lubricant to the threadline. A winding step 640, winds the high bulk continuous filament yarn onto suitable package with uniform package hardness to retain bulk in the yarn 522. Following winding, the yarn package can be used during weaving a weft yarn 40 as described above. In alternative embodiments, the yarn package may be used in the warp. However, in such an embodiment where the warp yarns are high bulk continuous filament yarns, the weft yarns 40 would be staple yarns.

The high bulk continuous filament yarns as described herein can be used as weft yarns as illustrated. In such an embodiment, the warp yarns are staple spun yarns. For instance, the warp yarns would not include any filament based yarns. In an alternative embodiment, the high bulk continuous filament yarns as described herein can be used as warp yarns and the woven construction can be such that warp yarns are exposed on the face 12 of the woven fabric. In such an embodiment, the weft yarns are staple spun yarns. For instance, the weft yarns would not include any filament based yarns.

It should be appreciated that the texturing apparatus and/or the texturing method 600 can be in-line with a weaving operation in a vertically integrated plant, or it may form a separate processes, the result of which is a yarn package for use in other textile operations, such as weaving, knitting, and the like.

Figure 5:
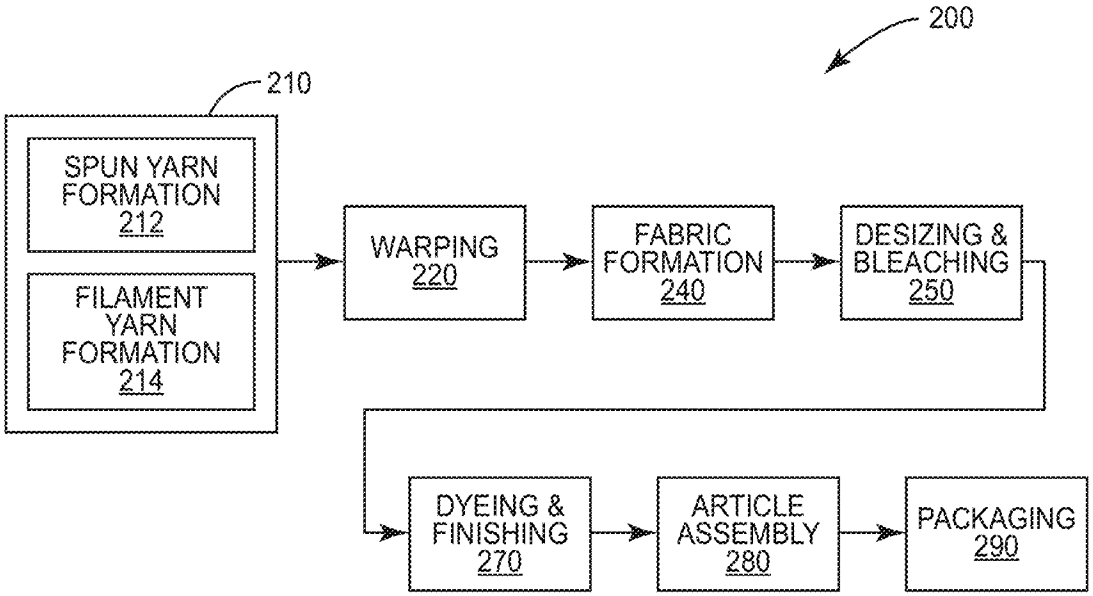
FIG. 5 is schematic process flow diagram for manufacturing the bedding article including the woven fabric illustrated in FIG. 1.

Another embodiment of the present disclosure is a method of making the woven fabric described above. Turning to FIG. 5, a method 200 of making woven fabric 10 according to an embodiment of the disclosure is illustrated. The method 200 includes yarn formation step 210. Yarn formation 210 for the warp yarns can include staple yarn formation step 212 and filament yarn formation step 214. Staple yarn formation 212 may utilize any number of staple yarn formation systems and sub-systems as described above with respect to the staple yarns. Filament yarn formation 214 involves melt spinning continuous filament yarns and texturizing the filament yarns to impart high bulk as described above.

After yarn formation 210, the yarns are warped in a warping step 220. The warping step 220 is where the warp yarn ends are removed from their respective yarn packages, arranged in a parallel form, and wound onto a warp beam, as is known to a person of skill in the weaving arts. The warping step 220 also includes a sizing step where a sizing agent is applied to each warp yarn to aid in fabric formation. The warping step 220 results in a warp beam of yarns that can be positioned on a mounting arm of a weaving loom so that the warp yarns can be drawn through the loom components according to the desired weave design.

Continuing with FIG. 5, a weaving step 240 forms a woven fabric using a weaving loom. More specifically, in the weaving step 240, the warp yarns are drawn-in (not shown) through various components of a weaving loom, such as drop wires, heddle eyes attached to a respective harness, reed and reed dents, in a designated order as is known in the art. Next, weaving proceeds through fabric a formation phase. The fabric formation phase creates a shed with the warp yarns that the weft or picks are inserted through across the width direction of the loom to create the desired woven fabric construction. Various shedding motions may be used, for example, such as cam, dobby, or jacquard shedding motions. The formation phase can utilize different weft insertion techniques, including air jet, rapier, or projectile type weft insertion techniques.

During the formation phase of the weaving step 240, weft yarns 40 are interwoven with the warp yarns 20 to define the woven design construction. Exemplary fabric woven constructions can include but are not limited to: plain weaves; basket weaves, satins (e.g. satin dobby base, satin stripe satin 5/1, satin 4/1 satin; 4/1 satin base strip; 4/1 stain swiss dot; 4/1 down jacquard; 5/1 satins); rib weaves (e.g. 2×1 rib weave; 2×2 rib weave; or 3×1 rib weave); twill weaves, and oxford weaves. In one example, the woven fabric is a plain weave. In another example, the woven fabric is a satin weave. In another example, the woven fabric is a 4/1 satin. In another example, the woven fabric is a 4/1 satin dobby diamond weave. In another example, the woven fabric is a 4/1 satin dobby stripe. In another example, the woven fabric is a 4/1 satin jacquard weave. The weaving step forms a woven fabric with a warp end density between about 50 warp ends per inch to about 300 warp ends per inch. The weft yarns can be inserted in such a manner to define a weft or pick density between about 50 picks per inch to about 300 picks per inch. Exemplary weaving constructions are summarized in table 1 below.

TABLE 1

| Example | Description |
|---|---|
| 1 | Warp: 60s Cotton, Weft 150D dope Dyed High bulk, PET fiament yarn. EPI = 165. PPI = 90 Width = 90 inchs to 130 inchs Weave type 4/1 Satin; |
| 2 | Warp: 40s Cotton Weft 150D dope dyed High bulk, PET fiament yarn EPI = 132, PPI = 72 Width = 90 inchs to 130 inchs Weave type 4/1 Satin |
| 3 | Warp: 30s Cotton Weft 150D dope dyed High bulk, PET fiament yarn EPI = 76, PPI = 68 Width = 90 inchs to 130 inchs Weave type Percale |
| 4 | Warp: 60s Cotton, Weft 150D dope dyed High bulk, PET fiament yarn. EPI = 165. PPI = 90 Width = 90 inchs to 130 inchs Weave type 4/1 Satin base dobby stripe, Jacquard |

Continuing with FIG. 5, after the weaving step 240, the woven fabric passes through desizing and bleaching step 250. Desizing may be accomplished with enzymes. Bleaching may include use of typical bleaching agents, such as hydrogen peroxide bleaching. During bleaching, the fabric is bleached with above chemicals and the cotton staple yarns are bleached. Step 250 may include singing the fabric.

Next, a dying and finishing step 270 applies color and one or more functional agents to the fabric. In an embodiment with cotton staple yarns, the cotton staple yarns are dyed with reactive dyes using a pad dry, pad steam, cold pad batch methods. Because the high bulk continuous filament yarns are dope or solution dyed, only the staple yarns are dyed during step 270. The dying step should match the natural fiber staple yarns to the high bulk, dope or solution dyed yarns. Step 270 may also include applying a composition including one or more of the functional agents to the woven fabric. The functional agents may include a softener, antimicrobial agent, etc. In one example, the finish composition may contain a silicone at about 5-20 gpl. Next, excess moisture is removed the woven fabric by advancing the fabric through a heating machine. Heating machines may be heated steam, infrared, hot air, surface rolls, hot oil can, through-air ovens, and like machines. After drying, the woven fabric may be sanforized and calendared to adjust the hand and better control shrinkage.

Continuing with FIG. 5, after the dyeing and finishing step 270, the woven fabric is assembled into the article in an assembly step 280. As illustrated, the assembly step 280 includes cutting the woven fabric to the size for the intended bedding article. During assembly, the bedding articles are constructed so that the face 12 of the woven fabric 10 is arranged to be the face of the bedding article. More specifically, the bedding articles are constructed so that face 12 of the woven fabric, a majority of which include exposed high bulk, continuous filament yarns, defines the skin-contact portion of the bedding articles. Thus, the high bulk continuous filament yarns define a predominate portion of the face of the bedding article. After the assembling step 280, a packaging step 290 places the bedding article in a suitable packaging for shipment.

Embodiments of the above described woven fabric and related methods result in improve end-use properties. Tables 2-6 below summarizes data used to evaluate woven fabrics formed as described herein. It should be appreciated that the below examples do not limit use of high bulk continuous filament yarns as warp yarns where the weft yarns are staple yarns. A person of skill in the art would appreciate that similar results may be possible when using high bulk continuous filament yarns in the warp that are exposed to the face of the fabric.

TABLE 2

A CONSTRUCTION DETAIL: 60*150D/180*90

| | Testing Parameter | Test Method | Result |
|---|---|---|---|
| 1 | Thread Count | ASTM D3775 | 270 |
| 2 | GSM | ASTM D3776 | 127 |
| 3 | Blend | AATCC 20/21 A | Cotton Yarn/PET Yarn |

TABLE 3

A CONSTRUCTION DETAIL: 60*150D/180*90

| | Testing Parameter | Test Method | Result |
|---|---|---|---|
| 1 | Stain Release Property | AATCC 130 | 270 |
| a | Coffee | AATCC 20/21 A | 4.5 |
| b | Red Wine | | 4.5 |
| c | Ketchup | | 4.5 |

TABLE 4

A CONSTRUCTION DETAIL: 60*150D/180*90

| | Testing Parameter | Test Method | Result |
|---|---|---|---|
| 1 | Durable Press | AATCC 143. | 270 |
| | After after 5 & 10 washes | AATCC 20/21 A | 3.5 |

TABLE 5

COLOR FASTNESS

| | Testing Parameter | Test Method | Result |
|---|---|---|---|
| 1 | Fastness to Light | AATCC 16 (option 3) | 4.5 |
| 2 | Fastness to Washing | AATCC 61 2(A) | |
| | Shade change | | 4-5 |
| | Staining | | 4-5 |
| | Self Staining | | 4-5 |
| 3 | Fastness to Crocking | AATCC-8 or 116 | |
| a | Dry | | 4-5 |
| b | Wet | | 4 |
| 5 | Color Fastness to Chlorine Bleach | AATCC 001 | 4.0 |
| 6 | Color Fastness to Non-Chlorine Bleach | AATCC 001 | 4.0 |

TABLE 6

| | Testing Parameter | Test Method | Results |
|---|---|---|---|
| 1 | Dimensional Stability (3HL) | AATCC-135 | |
| a | Warp | | −2.5% |
| b | Weft | | −1.0% |
| 2 | Tensile Strength | AATCC D 5034 | |
| a | Warp (LBS) | | 68 |
| b | Weft (LBS) | | 154 |
| 3 | Tearing Strength | ASTM D 1424 | |
| a | Warp (LBS) | | 5.49 |
| b | Weft (LBS) | | 11.26 |
| 4 | Seam Slippage | ASTM D 434 | |
| a | Warp (LBS) | | 45 |
| b | Weft (LBS) | | 33 |
| 5 | Seam Strength | ASTM D 1683 | |
| a | Warp (LBS) | | 44 |
| b | Weft (LBS) | | 32 |
| 6 | Pilling | ASTM D 4970 | 4 |
| 7 | DP Rating @ 5 washes | AATCC 124 | 3.5 |

While the disclosure is described herein using a limited number of embodiments, these specific embodiments are not intended to limit the scope of the disclosure as otherwise described and claimed herein. The precise arrangement of various elements and order of the steps of articles and methods described herein are not to be considered limiting. For instance, although the steps of the methods are described with reference to sequential series of reference signs and progression of the blocks in the figures, the method can be implemented in a particular order as desired.

What is claimed:

1. A woven fabric, comprising a plurality of warp yarns, each one the warp yarns being a staple spun yarn; and a plurality of weft yarns interwoven with the plurality of warp yarns to define the woven fabric, each one of the plurality of weft yarns being a high bulk textured continuous filament yarn, the high bulk textured continuous filament yarn having a thickness between about 0.5 mm to about 5.0 mm for a count of between about 20 denier to about 250 denier, wherein the woven fabric defines a first side and a second side that is opposite to the first side, wherein the plurality of weft yarns are interwoven with the plurality of warp yarns such that the weft yarns define a substantial majority of the first side of the woven fabric, thereby exposing the high bulk textured continuous filament yarn along the first side of the woven fabric.

2. The woven fabric of claim 1, wherein a substantial entirety of the first side is exposed weft yarns.

3. The woven fabric of claim 1, wherein the warp yarns do not include any continuous filament yarns.

4. The woven fabric of claim 1, wherein the weft yarns do not include any staple spun yarns.

5. The woven fabric of claim 1, wherein the high bulk textured continuous filament yarn has a bulk ratio between 1.1 and 3.0.

6. The woven fabric of claim 1, wherein the high bulk textured continuous filament yarn is a dope-dyed or solution dyed yarn.

7. The woven fabric of claim 1, wherein the high bulk textured continuous filament yarn is polyethylene terephthalate filament yarn, and the staple spun yarns include cotton fibers or a blend of two or more fibers.

8. A woven fabric, comprising:

a plurality of warp yarns, each one of the plurality of warp yarns being a high bulk textured continuous filament yarn, the high bulk textured continuous filament yarn having a thickness between about 0.5 mm to about 5.0 mm for a count of between about 20 denier to about 250 denier; and a plurality of weft yarns interwoven with the plurality of warp yarns to define the woven fabric, each one the plurality of weft yarns being a staple spun yarn, wherein the woven fabric defines a first side and a second side that is opposed to the first side, wherein the plurality of weft yarns are interwoven with the plurality of warp yarns such that the warp yarns define a substantial majority of the first side of the woven fabric, thereby exposing high bulk textured continuous filament yarns along the first side of the woven fabric.

9. The woven fabric of claim 8, wherein a substantial entirety of the first side is exposed warp yarns.

10. The woven fabric of claim 8, wherein the weft yarns do not include any continuous filament yarns.

11. The woven fabric of claim 8, wherein the warp yarns do not include any staple spun yarns.

12. The woven fabric of claim 8, wherein the high bulk textured continuous filament yarn has a bulk ratio between 1.1 and 3.0.

13. The woven fabric of claim 8, wherein the high bulk textured continuous filament yarn is a dope-dyed or solution dyed yarn.

14. The woven fabric of claim 8, wherein the high bulk textured continuous filament yarn is polyethylene terephthalate filament yarn, and the staple spun yarns include cotton fibers or a blend of two or more fibers.

15. A woven fabric, comprising:

a plurality of warp yarns; and a plurality of weft yarns interwoven with the plurality of warp yarns to define the woven fabric, and either a) an entirety of the weft yarns are high bulk textured continuous filament yarns and the warp yarns are staple spun yarns, or b) an entirety of the warp yarns are high bulk textured continuous filament yarns and the weft yarns are staple spun yarns, the high bulk textured continuous filament yarns having a thickness between about 0.5 mm to about 5.0 mm for a count of between about 20 denier to about 250 denier, wherein the woven fabric defines a first side and a second side that is opposed to the first side, wherein the plurality of weft yarns are interwoven with the plurality of warp yarns such that the high bulk textured continuous filament yarns define a substantial majority of the first side of the woven fabric.

16. The woven fabric of claim 15, wherein a substantial entirety of the first side includes high bulk textured continuous filament yarns.

17. The woven fabric of claim 15, wherein the warp yarns do not include any continuous filament yarns when an entirety of the weft yarns are staple spun yarns.

18. The woven fabric of claim 15, wherein the weft yarns do not include any continuous filament yarns when an entirety of the warp yarns are staple spun yarns.

19. The woven fabric of claim 15, wherein the high bulk textured continuous filament yarns have a bulk ratio between 1.1 and 3.0.

20. The woven fabric of claim 15, wherein each of the high bulk textured continuous filament yarns are dope-dyed or solution dyed yarns.

21. The woven fabric of claim 20, wherein the high bulk textured continuous filament yarns are polyethylene terephthalate filament yarns, and the staple spun yarns include cotton fibers or a blend of two or more fibers.

22. A method for manufacturing a woven fabric, the method comprising the steps of:

weaving the woven fabric with a plurality of warp yarns and a plurality of weft yarns, and either a) an entirety of the weft yarns are high bulk textured continuous filament yarns and the warp yarns are staple spun yarns, or b) an entirety of the warp yarns are high bulk textured continuous filament yarns and the weft yarns are staple spun yarns, the high bulk textured continuous filament yarns having a thickness between about 0.5 mm to about 5.0 mm for a count of between about 20 denier to about 250 denier, and wherein the warp and weft yarns are arranged such that such that the high bulk textured continuous filament yarns define a substantial majority of a first side of the woven fabric.

23. The method of claim 22, wherein the weft yarns are the high bulk textured continuous filament yarns and the warp yarns are staple spun yarns, and the weaving step further comprises repeatedly inserting one of the high bulk textured continuous filament yarns into a shed of warp yarns.

24. The method of claim 22, wherein the warp yarns are the high bulk textured continuous filament yarns and the weft yarns are staple spun yarns, and the weaving step further comprises repeatedly inserting staple spun yarns into a shed of warp yarns.

25. The method of claim 22, further comprising the step of processing a continuous filament yarn to impart bulk to thereby form the high bulk textured continuous filament yarns.

26. The method of claim 25, wherein the continuous filament yarn includes a plurality of filaments, wherein the step of processing the continuous filament yarn includes:

twisting the continuous filament yarn to form a twisted continuous filament yarn;

thermally treating the twisted continuous filament yarn to at least partially heat set the twisted continuous filament yarn to form a heat set twisted continuous filament yarn;

after the thermal treatment step, intermingling the plurality of filaments to form a high bulk textured continuous filament yarn; and winding the high bulk continuous filament yarn onto a yarn package.

27. The woven fabric of claim 1, wherein the weft yarns are 1) polyethylene terephthalate filament yarns, 2) have a count from about 20 denier to about 250 denier, and 3) have a pick density from about 50 picks per inch to about 300 picks per inch, and wherein the warp yarns a) have a count between about 66.4 denier to about 177 denier and b) have a warp end density from about 50 warp ends per inch to about 300 warp ends per inch.

28. The woven fabric of claim 8, wherein the warp yarns are 1) polyethylene terephthalate filament yarns, 2) have a count from about 20 denier to about 250 denier, and 3) have a warp end density from about 50 warp ends per inch to about 300 warp ends per inch, and wherein the weft yarns a) have a count between about 66.4 denier to about 177 denier and b) have a pick density from about 50 picks per inch to about 300 picks per inch.

29. The woven fabric of claim 15, wherein the high bulk textured continuous filament yarns are 1) polyethylene terephthalate filament yarns, and 2) have a count from about 20 denier to about 250 denier, wherein the staple spun yarns have a count between about 66.4 denier to about 177 denier, wherein the warps yarns have a warp end density from about 50 warp ends per inch to about 300 warp ends per inch, and wherein the weft yarns have a pick density from about 50 picks per inch to about 300 picks per inch.

30. The method of claim 22, wherein the high bulk textured continuous filament yarns are 1) polyethylene terephthalate filament yarns, and 2) have a count from about 20 denier to about 250 denier, wherein the staple spun yarns have a count between about 66.4 denier to about 177 denier, wherein the warps yarns have a warp end density from about 50 warp ends per inch to about 300 warp ends per inch, and wherein the weft yarns have a pick density from about 50 picks per inch to about 300 picks per inch.

* * * * *